United States Patent [19]

Knoth

[11] Patent Number: 4,897,793

[45] Date of Patent: Jan. 30, 1990

[54] CONFIGURATION FOR A FRANKING MACHINE

[75] Inventor: Norbert Knoth, Berlin, Fed. Rep. of Germany

[73] Assignee: Francotyp-Postalia GmbH, Berlin, Fed. Rep. of Germany

[21] Appl. No.: 148,543

[22] Filed: Jan. 26, 1988

[51] Int. Cl.[4] ..... G07B 17/00

[52] U.S. Cl. ..... 364/464.03; 364/478

[58] Field of Search ..... 364/464.03, 466, 478

[56] References Cited

U.S. PATENT DOCUMENTS

| | | | |
|---|---|---|---|
| 3,890,492 | 6/1975 | Manduley et al. | 364/464.03 |
| 4,093,999 | 6/1978 | Fuller et al. | 364/900 |
| 4,516,209 | 5/1985 | Scribner | 364/464.03 |
| 4,707,715 | 11/1987 | Miura | 902/18 X |
| 4,833,703 | 5/1989 | Suzuki | 379/67 |

*Primary Examiner*—Parshotam S. Lall
*Assistant Examiner*—Edward R. Cosimono
*Attorney, Agent, or Firm*—Herbert L. Lerner; Laurence A. Greenberg

[57] ABSTRACT

A configuration for a franking machine includes a central control in the form of a processor. A drive of the franking machine, a printing drum, an interface component for connection to drives of peripheral devices disposed upstream and downstream of the franking machine and a common keyboard are all connected to the processor. The common keyboard enters an amount to be printed and controls the franking machine for reducing mechanical wear and noise and for saving energy. Another control in the form of a timing member is associated with the processor. The timing member places the drive of the franking machine into a standby position by generating a switch-off signal if no material to be stamped is touching the printing drum and no value has been entered through the keyboard during a given monitoring time period preset by the timing member. The timing member also controls the drives of the peripheral devices through the interface component.

10 Claims, 2 Drawing Sheets

CONFIGURATION FOR A FRANKING MACHINE

BACKGROUND OF THE INVENTION

1. Field of the Invention

The invention relates to a configuration for a franking machine, including central control means in the form of a processor, a drive, a printing drum and a common keyboard for entering the amount to be printed and for controlling the franking machine in order to reduce mechanical wear and noise and to save energy.

2. Description of the Related Art

Conventional franking machines are used as postage meters, fee stamp or tax stamp machines. Additional peripheral devices are used for automating the steps for handling the mail or other material to be sent. For example, folding and inserting devices as well as closing machines and scales are positioned upstream of a postage meter and downstream of a staggering stacker. Staggering stackers are used for advancing the stamped material emerging from the franking machine, for gather it for bundling and, if desired, for tieing the bundles. Devices for departmental accounting and journal printers can also be operated in parallel with a postage meter.

The peripheral devices are controlled in relation to the speed of the postage meter or the free stamp printer in such mail handling lines. When the devices are idling, it results in is a very high noise level. Additional generation of heat and increased wear and use of energy can be expected as well.

It is accordingly an object of the invention to provide a configuration for a franking machine, which overcomes the hereinafore-mentioned disadvantages of the heretofore-known devices of this general type, which reduces energy use and wear during idle times and which reduces irritation caused by noise in such systems as much as possible.

SUMMARY OF THE INVENTION

With the foregoing and other objects in view there is provided, in accordance with the invention, a configuration for a franking machine, comprising central control means in the form of a processor, a drive of the franking machine connected to the processor, a printing drum connected to the processor, an interface component connected to the processor for connection to drives of peripheral or auxiliary devices disposed upstream and downstream of the franking machine, a common keyboard connected to the processor for entering an amount to be printed and for controlling the franking machine for reducing mechanical wear and noise and for saving energy, and other control means in the form of a timing member associated with the processor, the timing member including means for placing the drive of the franking machine into a standby or idle position by generating a switch-off signal if no material to be stamped is touching the printing drum and no value has been entered through the keyboard during a given monitoring time period preset by the timing member, and the timing member including means for controlling the drives of the peripheral devices through the interface component.

In accordance with another feature of the invention, there is provided a main switch of the franking machine returning the drive of the franking machine and the drives of the peripheral or auxiliary devices to an operational state.

In accordance with a further feature of the invention, the keyboard includes an operating element returning the drive of the franking machine and the drives of the peripheral or auxiliary devices to an operational state.

In accordance with an added feature of the invention, there are provided means for issuing a peripheral signal returning the drive of the franking machine and the drives of the peripheral or auxiliary devices to an operational state.

In accordance with an additional feature of the invention, the keyboard includes means for storing the length of the given monitoring time period preset by the timing member in the processor.

In accordance with yet another feature of the invention, the keyboard includes means for inactivating the timing member by the entry of a zero value.

In accordance with yet a further feature of the invention, the timing member is integrated into the processor.

In accordance with yet an added feature of the invention, there are provided means for generating control signals for the peripheral devices from the switch-off signal of the timing member.

In accordance with yet an additional feature of the invention, there are provided means for controlling a data transfer control device with the switch-off signal.

In accordance with a concomitant feature of the invention, there are provided operational switching elements interconnecting the timing member and the processor with the drive of the franking machine.

A further advantage of this configuration is a savings in energy and the omission of a test run when the franking machine is restarted, which results in a quicker operational readiness.

Other features which are considered as characteristic for the invention are set forth in the appended claims.

Although the invention is illustrated and described herein as embodied in a configuration for a franking machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
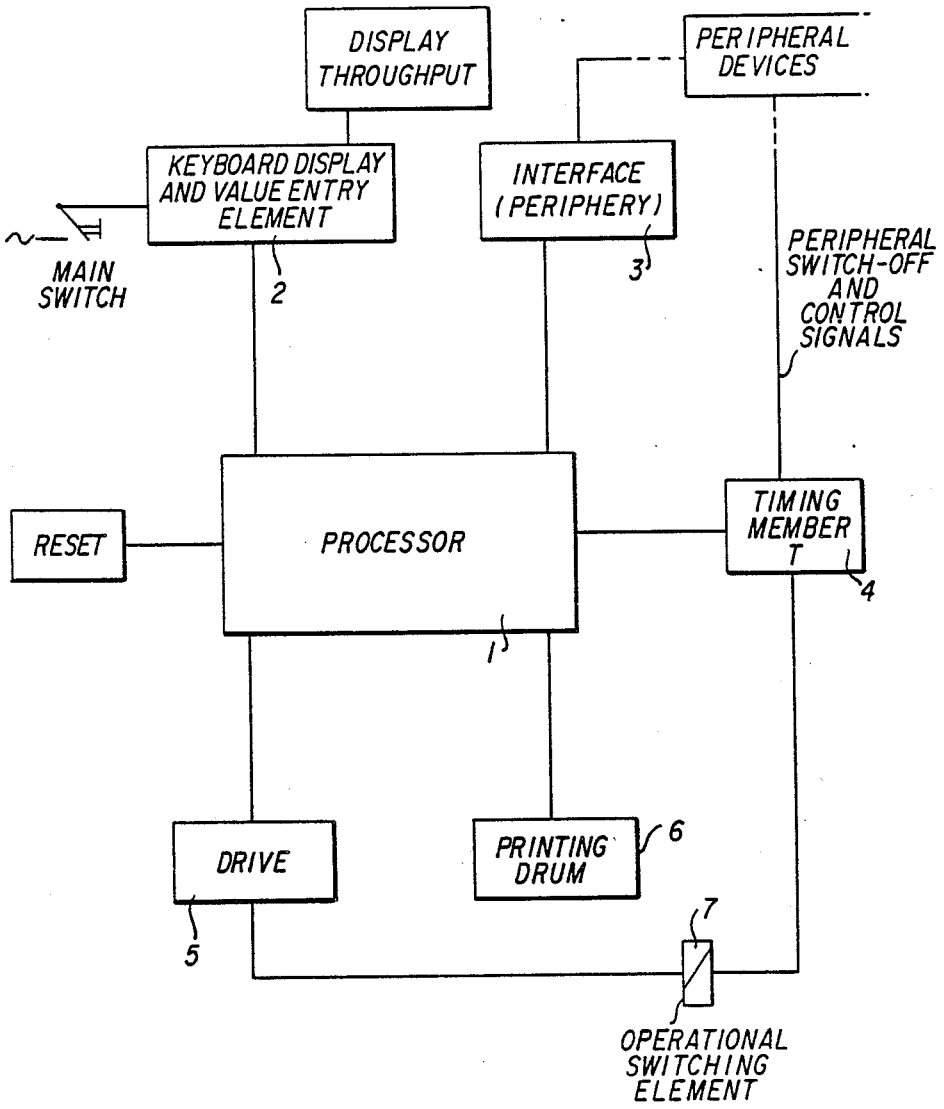
FIG. 1 is a block diagram of a franking machine.

Referring now to the figures of the drawings in detail and first, particularly, to FIG. 1 thereof, it is seen that the franking machine has a central processor 1 for the control of the operations thereof. The values set for the machine are communicated to the processor through a keyboard and display 2 and are processed and stored. The set values may be amounts to be printed, particular printings for mailing, dates, etc. These preset values and others calculated by the processor 1 as well as stored notices concerning replenishment of postage or maintenance cycles, for example, are made visible on a screen.

An interface component 3 which controls associated peripheral or auxiliary devices is also assigned to the processor 1, as shown in FIG. 1. This may be required, for example, for coordinating the speed of metering mail with the speed of an inserting machine placed upstream and a staggering or layering stacker placed downstream. Furthermore, associated parallel devices are controlled by means of the interface component, as mentioned above.

A timing member 4 in the form of an external component or a part of the processor is associated with the control devices. A drive 5, operational switching elements 7 such as operational transistors or relays, and control means, such as the keyboard and display 2, the interface component 3 and the timing member 4, are interconnected in accordance with the invention in such a way that, after a time which can be set or preset, the drive of the franking machine and, if desired, the drive of the peripheral devices can be shut off, if the franking machine or the printing drum 6 thereof have not been in operation.

Figure 2:
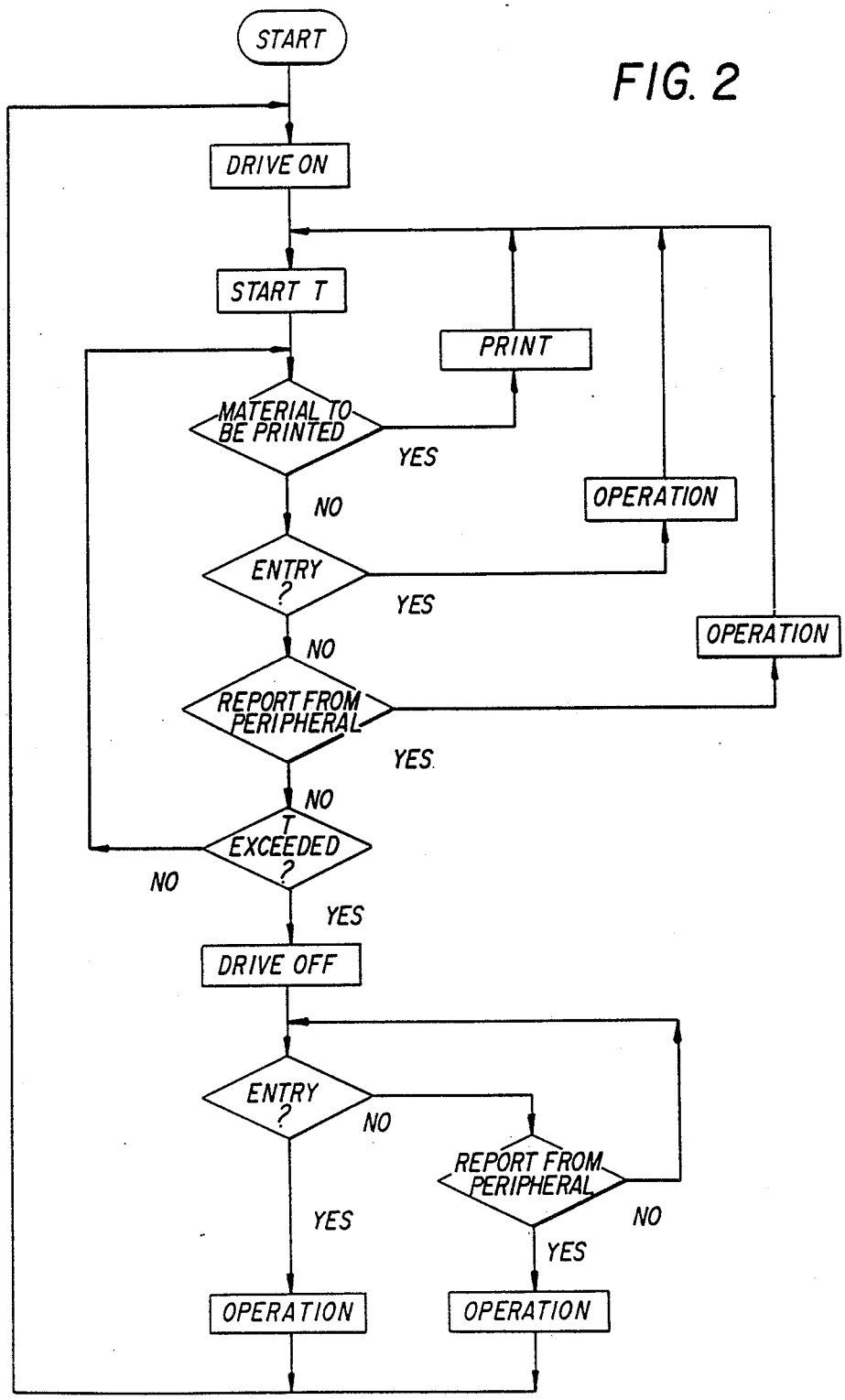
FIG. 2 is a data flow chart showing the control of the machine.

The sequence of switching is shown in the flow chart of FIG. 2. Starting is accomplished, for example, by a main switch 8. After the drive of the franking machine is switched on by operational switch elements the timing member is started. Parallel to this operation, the drives of the peripheral devices placed upstream and/or downstream can be correspondingly controlled through the interface component.

After the drive is switched on, the timing member 4 is started. After a check of whether or not there is material to be stamped in the franking machine and whether or not a value has been entered, the reports of the internal value and settings of printing drum 6 and, if desired, the reports of the peripheral devices, are checked. Such a check of the peripheral devices is necessary to determine the perfect mechanical operation of the devices, for example the running of the staggering stacker and readiness for registering the stamped values for the purpose of the fee calculation. If the required checks and reports are positive, further operation or the printing of stamps is released. This switching sequence is continuously repeated, with the timing member being again started after each printing of a stamp or each operation.

If there is no material to be stamped in the franking machine, or if a value has not been entered or is incomplete, or if there is no acknowledgment from the peripheral devices, checks are performed within the time T monitored by the timing member until appropriate positive acknowledgements are made.

If one of the reports has not been made after the time T preset by the timing member 4, the drive of the franking machine is shut off. The drives of the peripheral device can also be shut off parallel to this by means of the interface component.

With the drive shut off, constant checks are made as to whether or not a keyboard entry was made or a report from a peripheral device was received, as long as the main switch is being operated. If a report or an entry was made, the drive of the franking machine and, if desired, the drive of the peripheral devices, is switched on again and the timing member is restarted. The switching sequence takes place as previously described.

The renewed operational state of the franking device is thus achieved either by a peripheral signal, for example by a report from scales, or by entering a new value in an operating element, which is the keyboard in the illustrated embodiment.

Renewed operation of the main switch 8 also results in the drive being switched on.

The length of the monitoring time of the timing member 4 can be arbitrarily selected. It is entered through the keyboard and display 2 by choosing a code number or by simultaneously operating two keys for modifying the present keyboard and subsequent selecting the monitoring time, for example as entry in the form of seconds. Thus an additional functional key for modifying the keyboard is not required.

By entering a zero value or a predetermined additional code number, the timing member 4 is made non-operational so that the drive 5 of the franking machine is continuously switched on.

The selected time values are preferably stored in the processor 1 which controls the timing member 4 accordingly. Thus the timing member 4 can also be integrated in the processor.

Control signals for the peripheral devices which control the drives of these devices parallel to the drive of the franking machine are derived from the switch-off signal generated by the timing member 4.

Additionally, the switch-off signal can be used for data transfer control in order to generate a display at a remote location as an operational check and, if desired, a registration of the operational hours.

I claim:

1. Configuration for a franking machine, comprising central control means in the form of a processor, a drive of the franking machine connected to said processor, a printing drum connected to said processor, an interface component connected to said processor for connection to drives of peripheral devices disposed upstream and downstream of the franking machine, a common keyboard connected to said processor for entering an amount to be printed and for controlling the franking machine for reducing mechanical wear and noise and for saving energy, and other control means in the form of a timing member associated with said processor, said timing member including means for placing said drive of the franking machine into a standby position by generating a switch-off signal if no material to be stamped is touching said printing drum and no value has been entered through said keyboard during a given monitoring time period preset by said timing member, and means included in said timing member for controlling the drives of the peripheral devices through said interface component.

2. Configuration according to claim 1, including a main switch of the franking machine returning said drive of the franking machine and the drives of the peripheral devices to an operational state.

3. Configuration according to claim 1, wherein said keyboard includes value entry element for returning said drive of the franking machine and the drives of the peripheral devices to an operational state.

4. Configuration according to claim 1, including means for issuing a peripheral control signal for returning said drive of the franking machine and the drives of the peripheral devices to an operational state.

5. Configuration according to claim 1, wherein said timing member is integrated into said processor.

6. Configuration according to claim 1, including operational switching elements interconnecting said timing member and said processor with said drive of the franking machine.

7. Configuration according to claim 1, wherein said keyboard includes means for entry of the value of length of said given monitoring time period preset by said timing member in said processor.

8. Configuration according to claim 7, wherein said keyboard includes means for inactivating said timing member by the entry of a zero value.

9. Configuration according to claim 1, including means for generating control signals for the peripheral devices from said switch-off signal of said timing member.

10. Configuration according to claim 9 including control signal means for controlling a data transfer control device with said switch-off signal.

* * * * *